US006551263B2

(12) United States Patent
Turner

(10) Patent No.: US 6,551,263 B2
(45) Date of Patent: Apr. 22, 2003

(54) MASSAGE GENERATOR FOR A SPA

(75) Inventor: Denis P. Turner, Oceanside, CA (US)

(73) Assignee: Watkins Manufacturing Corporation, Vista, CA (US)

( * ) Notice: Subject to any disclaimer, the term of this patent is extended or adjusted under 35 U.S.C. 154(b) by 0 days.

(21) Appl. No.: 09/864,485

(22) Filed: May 24, 2001

(65) Prior Publication Data

US 2002/0053105 A1 May 9, 2002

Related U.S. Application Data

(60) Provisional application No. 60/246,836, filed on Nov. 8, 2000.

(51) Int. Cl.[7] ..... A61H 23/04

(52) U.S. Cl. ..... 601/148; 4/575.1

(58) Field of Search ..... 601/148, 149, 601/150

(56) References Cited

U.S. PATENT DOCUMENTS 4,839,930 A * 6/1989 Watkins ..... 601/148
4,908,888 A * 3/1990 Watkins ..... 601/148
5,928,171 A * 7/1999 Larsen ..... 601/148

* cited by examiner

*Primary Examiner*—Robert M. Fetsuga

(57) ABSTRACT

A neck massage apparatus for use in a spa hot tub system. The massage apparatus includes a pair of rotating jet nozzles located at a height near the neck of a user thereof sitting in the spa, wherein the jet nozzles are coupled to a source of water and air, respectively. A pliable membrane is disposed over the jet nozzles for restraining the water and air and for imparting a massage sensation to the user in response to movement of the water and air. Controlled size orifices are placed in the back of the apparatus to allow the water and air to escape. The size of these orifices are controlled to be slightly greater in area than the area of the combined air and water source pipes, thereby placing adequate pressure on the membrane to adapt to the shape of the user's neck and to impart a massage sensation.

17 Claims, 9 Drawing Sheets

MASSAGE GENERATOR FOR A SPA

CROSS-REFERENCE TO RELATED APPLICATION

This application claims the benefit of U.S. Provisional U.S. Patent Application Serial No. 60/246,836 entitled, filed Nov. 8, 2000.

BACKGROUND OF THE INVENTION

1. Field of the Invention

The present invention relates to an apparatus for use in a spa that generates a pulsating massage for the neck. In particular, this invention relates to a neck jet massage generator adjustable for various heights of the user.

2. Description of Related Art

Prior art spa massage devices are typically jet nozzles in the spa itself, which work great for massaging the lower body parts. However, these jets are usually too low for massaging the neck. Worse yet, the prior art massage jet devices are usually underwater and are inconvenient for massaging the neck.

Therefore, a need exists for a spa massage unit that is comfortable for massaging the neck of a user while sitting in the spa. Moreover, there is a need for a neck massage unit that is simple to use and adjustable for various heights of the user.

SUMMARY OF THE INVENTION

An object of the present invention is to provide a modular spa neck jet massage generator, which is adjustable to various heights of a user.

Another object of the present invention is to provide a spa neck jet massage generator that is adjustable in height even when the spa water pump is running.

Yet another object of the present invention is to provide a spa neck jet massage generator with a built-in trim valve, which allows for a pressure drop at the transition point between the air/water supply pipes and the air/water intakes and reduces leakage at the interface, besides providing smooth operation when the pump is turned on. The trim valve also reduces water hammer action when the pump is first turned on.

Another feature of the present invention is reduced friction loss of water flow by reducing the restrictions in the water flow path, which enables the system to run at 85% of water flow capacity thereby providing a nominal working pressure of 10 to 15 PSI for the neck jet massage generator.

Still another feature of the present invention is the provision of water flow control by a calculated orifice, which allows water to drain from the main frame or pillow cavity to the back of the spa allowing 1 to 2 PSI to be built up behind the pillow. This creates a soft pillow support and allows for water waves to be transferred through the water in order to generate the soft, yet constant, massage action; which action occurs in response to any given depression of the pillow.

These and other objects features and advantages, which will become apparent as the invention is described in detail below, are provided by a neck massage apparatus for use in a spa hot tub system. The massage apparatus includes a pair of rotating jet nozzles located at a height near the neck of a user thereof sitting in the spa, wherein the jet nozzles are coupled to a source of water and air, respectively. A pliable membrane is disposed over the jet nozzles for restraining the water and air and for imparting a massage sensation to the user in response to movement of the water and air. Controlled size orifices are placed in the back of the apparatus to allow the water and air to escape. The size of these orifices are controlled to be slightly greater in area than the area of the combined air and water source lines, thereby placing adequate pressure on the membrane to adapt to the shape of the user's neck and to impart a massage sensation.

Still other objects, features and advantages of the present invention will become readily apparent to those skilled in the art from the following detailed description, wherein is shown and described only the preferred embodiment of the invention, simply by way of illustration of the best mode contemplated of carrying out the invention. As will be realized, the invention is capable of other and different embodiments, and its several details are capable of modifications in various obvious respects, all without departing from the invention. Accordingly, the drawings and description are to be regarded as illustrative in nature, and not as restrictive, and what is intended to be protected by Letters Patent is set forth in the appended claims

BRIEF DESCRIPTION OF THE DRAWINGS

The general purpose of this invention, as well as a preferred mode of use, its objects and advantages will best be understood by reference to the following detailed description of an illustrative embodiment with reference to the accompanying drawings in which like reference numerals designate like parts throughout the figures thereof, and wherein.

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide a height adjustable neck jet massage generator for use in a spa.

Figure 1:
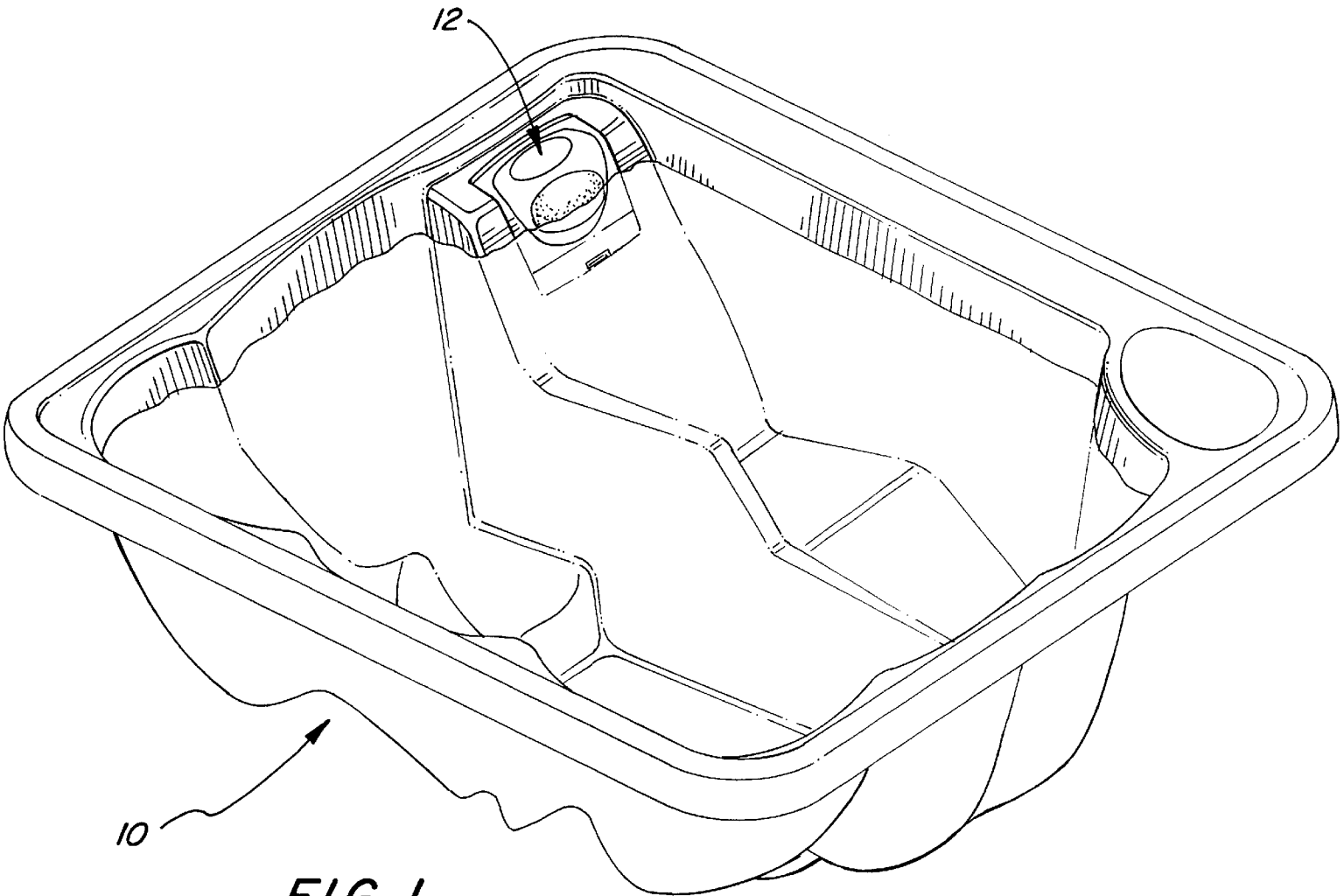
FIG. 1 is a perspective illustration of a spa in which the neck jet massage generator of the present invention may be useful.
Figure 2:
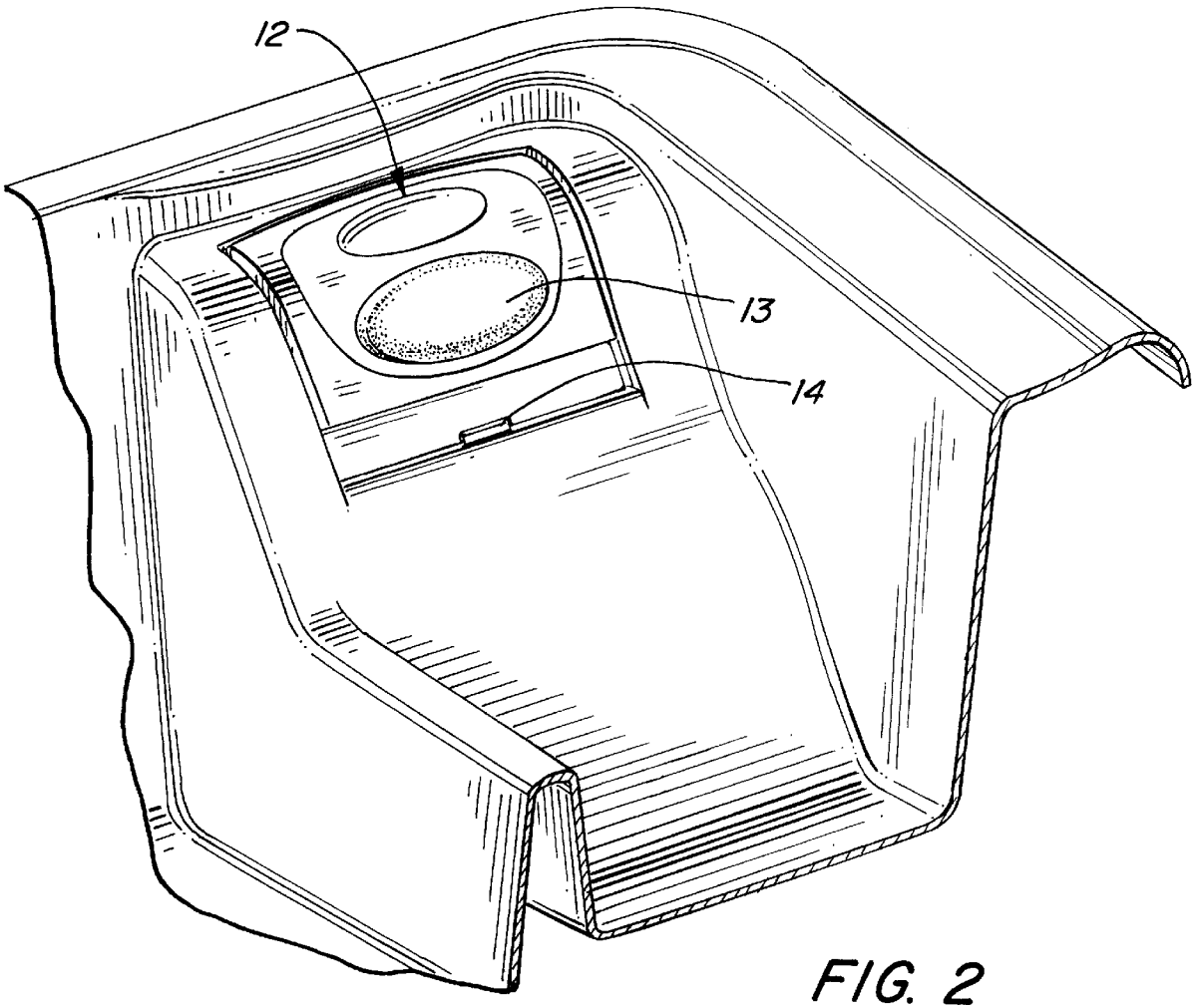
FIG. 2 is a perspective illustration of the neck jet massage generator according to the present invention.

Referring to the drawings and FIG. 1 in particular, a spa 10 including a neck jet massage generator or pillow 12 according to the present invention is shown. FIG. 2 shows the pillow 12 in greater detail, which includes a membrane 13 for supporting a user's neck. The membrane 13 is preferably made of a soft material sold under the name of 7043 MSF Black PVC, manufactured by Colorite Plastics of Sparks, Nev. A height adjustment button 14 is disposed immediately below the membrane 13, and when depressed one may move the pillow 12 up or down, which in one embodiment is adjustable for users between a height of 5'6" and 6'3".

Figure 3:
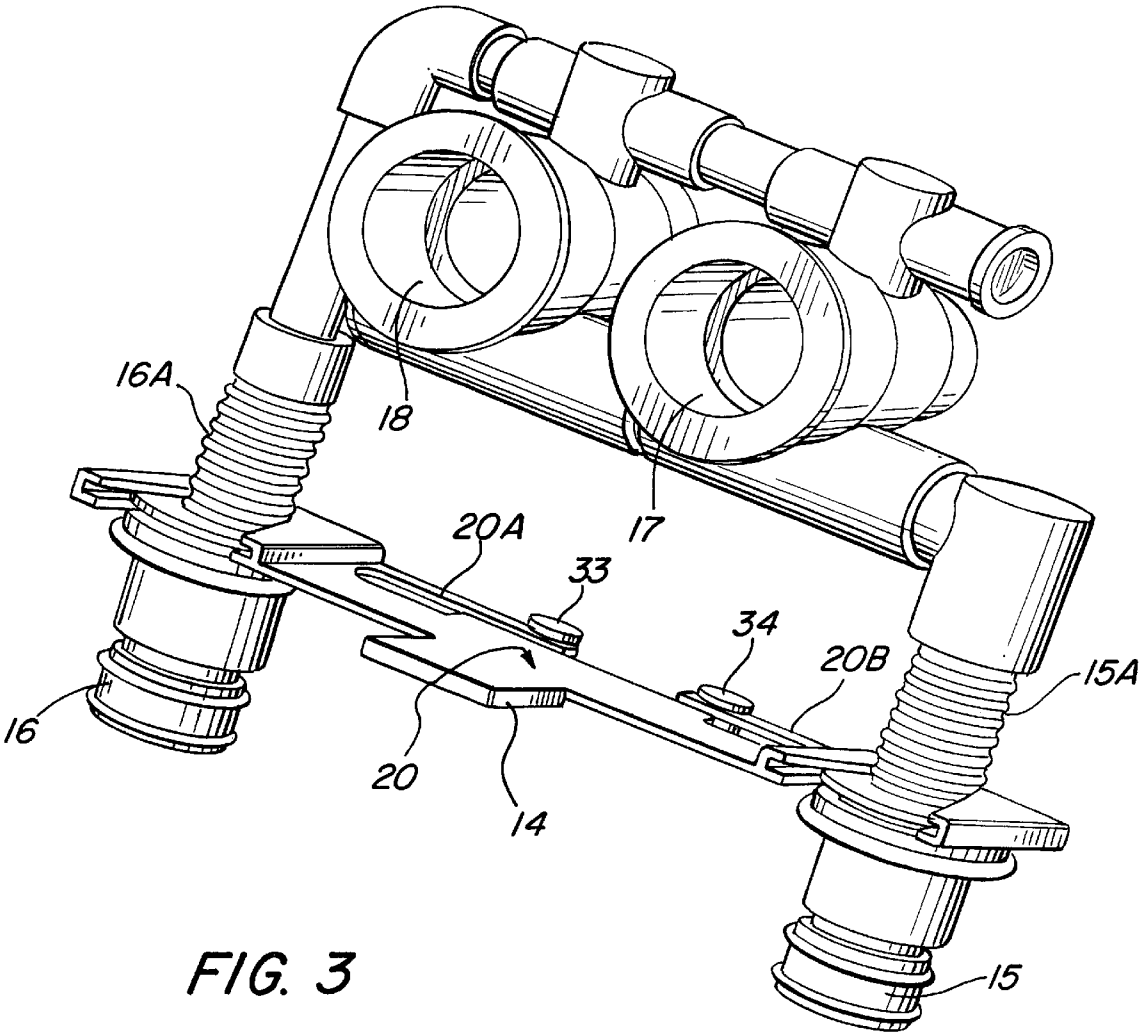
FIG. 3 is a perspective illustration of the plumbing details of the neck jet massage generator.
Figure 4:
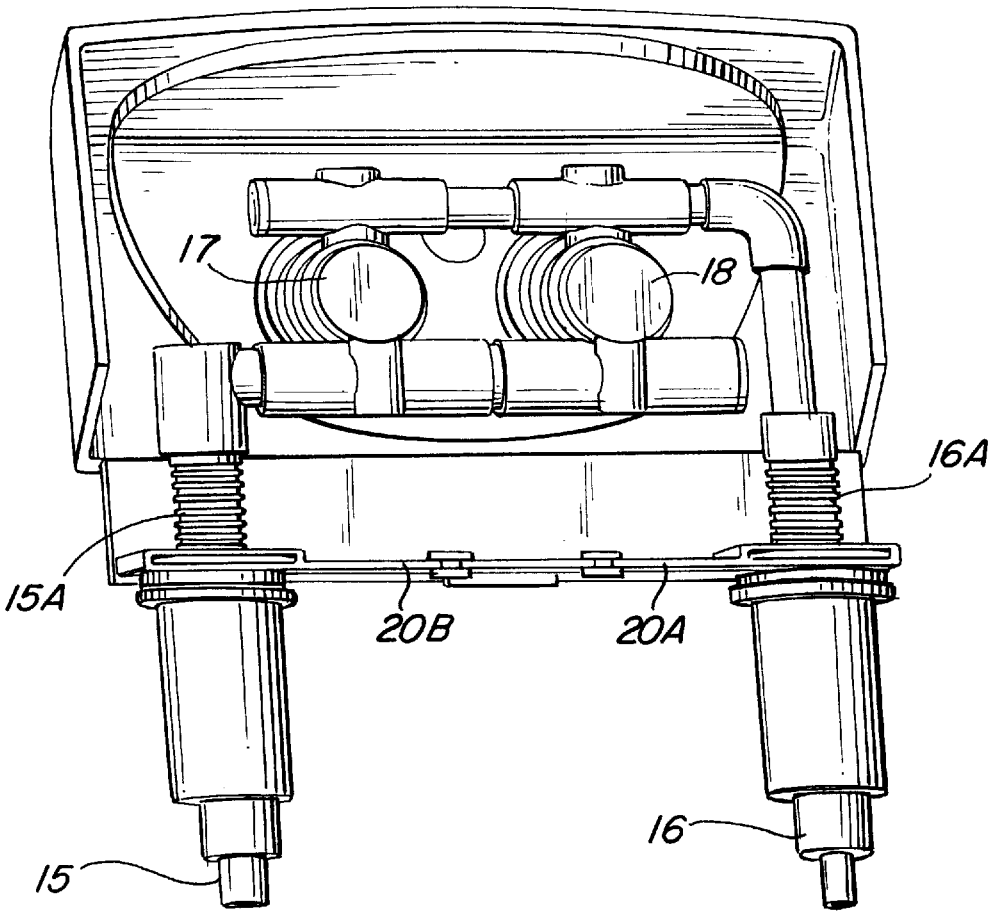
FIG. 4 is a rear perspective view of the plumbing for the neck jet massage generator.

Referring now to FIG. 3, details of the plumbing behind the pillow 12 and the height adjustment mechanism behind the button 14 are shown. A water intake 15 supplies water to jets (not shown), which jets fit into receptacles 17 and 18; and, an air intake 16 supplies air to these same jets. A set of ridges 15A are formed in the water intake 15 and an identical set of ridges 16A are formed in the air intake 16. The ridges 15A and 16A are used by a height adjustment mechanism 20, as will be amplified hereinafter. The height adjustment button 14 presses against arms 20A and 20B of the height adjustment mechanism 20, which will also be amplified hereinafter. FIG. 4 shows a rear view of the same structure illustrated in FIG. 3 and described hereinabove, wherein like reference numerals are used for the same components.

Figure 5:
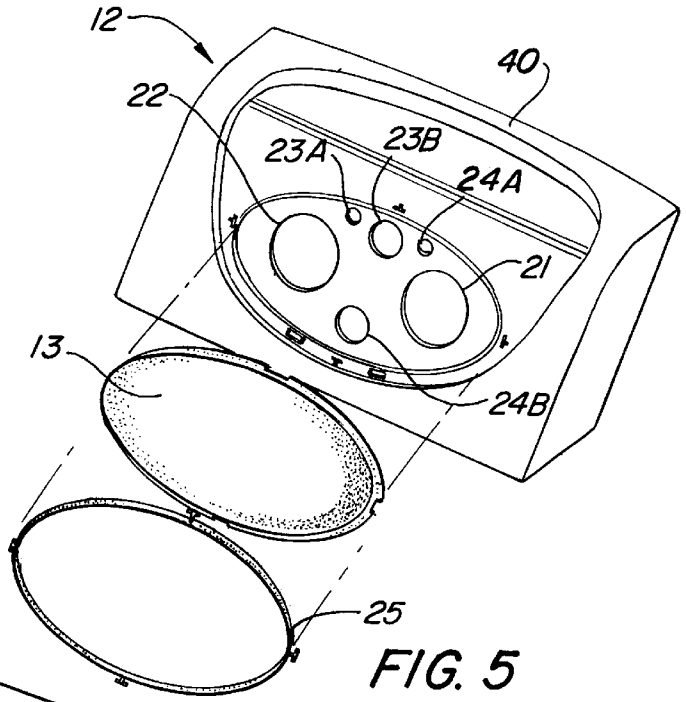
FIG. 5 is an exploded perspective view of the housing and pillow for the neck jet massage generator.

Referring now to FIG. 5, an exploded perspective view of the pillow 12, including the membrane 13, for the neck jet massage generator is shown. In particular, the massage generator is enclosed in a housing 40 having openings 21 and 22 for receiving the receptacles 17 and 18, respectively, and calculated orifices or openings 23A, 23B, 24A and 24B for return of water in the pillow 12 to the spa. The combined area of the exhaust openings 23A, 23B, 24A and 24B is larger than the combined area of the water intake 15 and air intake 16 lines. With the same pressure at the exhaust and intake lines, more water escapes the cavity formed by the membrane 13 than comes into this cavity. However, the water and air being applied to the cavity through the intake lines is at a greater pressure than the water at the exhaust, causing the membrane to be slightly pressurized, and adapt to the shape of a user's neck and provide a massaging sensation. The pressure at the intake lines is about 10–15 PSI, while the pressure at the exhaust orifices is about 1–2 PSI.

The membrane 13 is held in the pillow housing 40 by means of a snap ring 25, which is held in place by screws. Other means may be used for securing the pillow 13, such as a ring with multiple screws.

Figure 6:
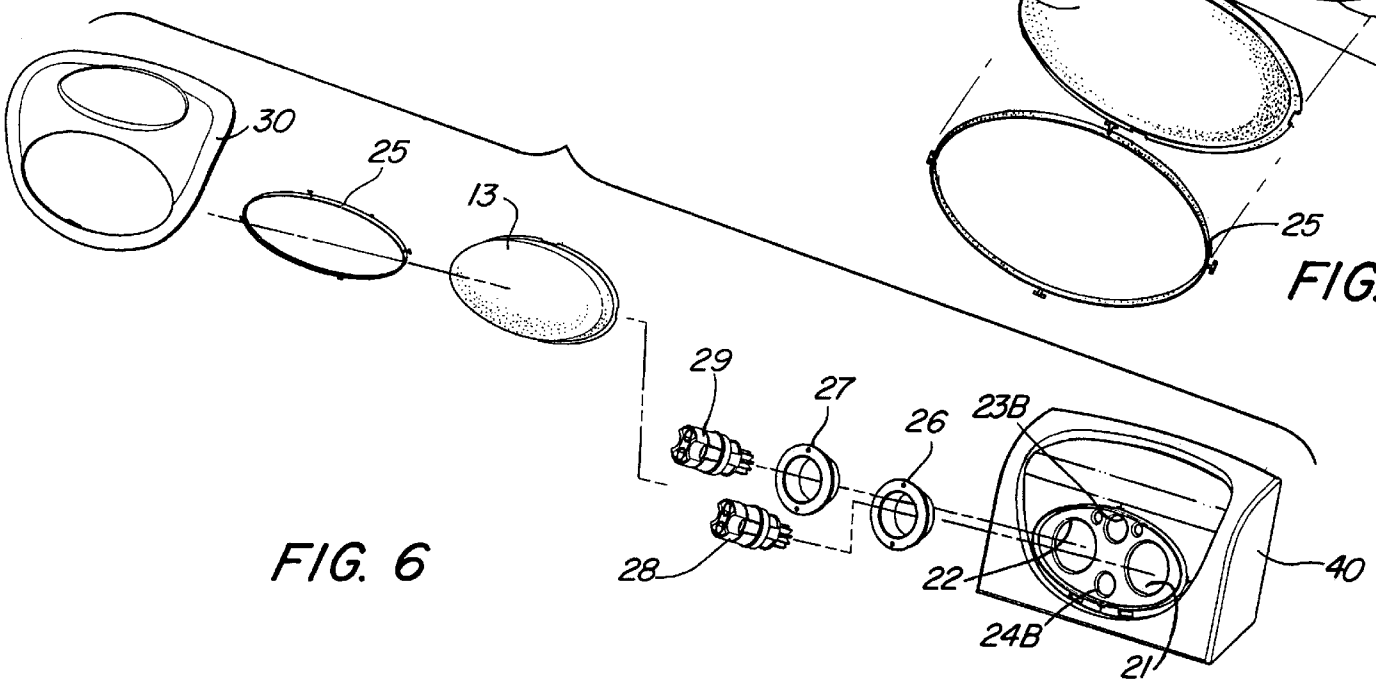
FIG. 6 is an exploded perspective view of the constituent parts of the neck jet massage generator.

Referring now to FIG. 6, an exploded perspective view of the neck jet massage generator (excluding the plumbing) is shown. Jet bodies 26 and 27 are inserted into the openings 21 and 22, respectively; and, jet nozzle assemblies 28 and 29 are inserted into the bodies 26 and 27, respectively. The jet nozzle assemblies 28 and 29 are rotating jet nozzles available from Hayward Pool Products, Pomona, Calif., under model No. SP 1436PAKB50 or SP14342PAK50. The net nozzle assemblies are joined to the plumbing jet receptacles 17 and 18, respectively. Thus, when water is applied to the intake 15 and air travels through the intake 16, a jet stream of water and air are released by the jet nozzle assemblies 28 and 29. However, as will be shown in greater detail hereinbelow, the air and water are trapped by the membrane 13. The action of the jet stream on the inside of the membrane 13 cause a vibration on the outside thereof, which imparts the neck massage according to the present invention. A cover 30 is placed over the entire structure for protection.

Figure 7:
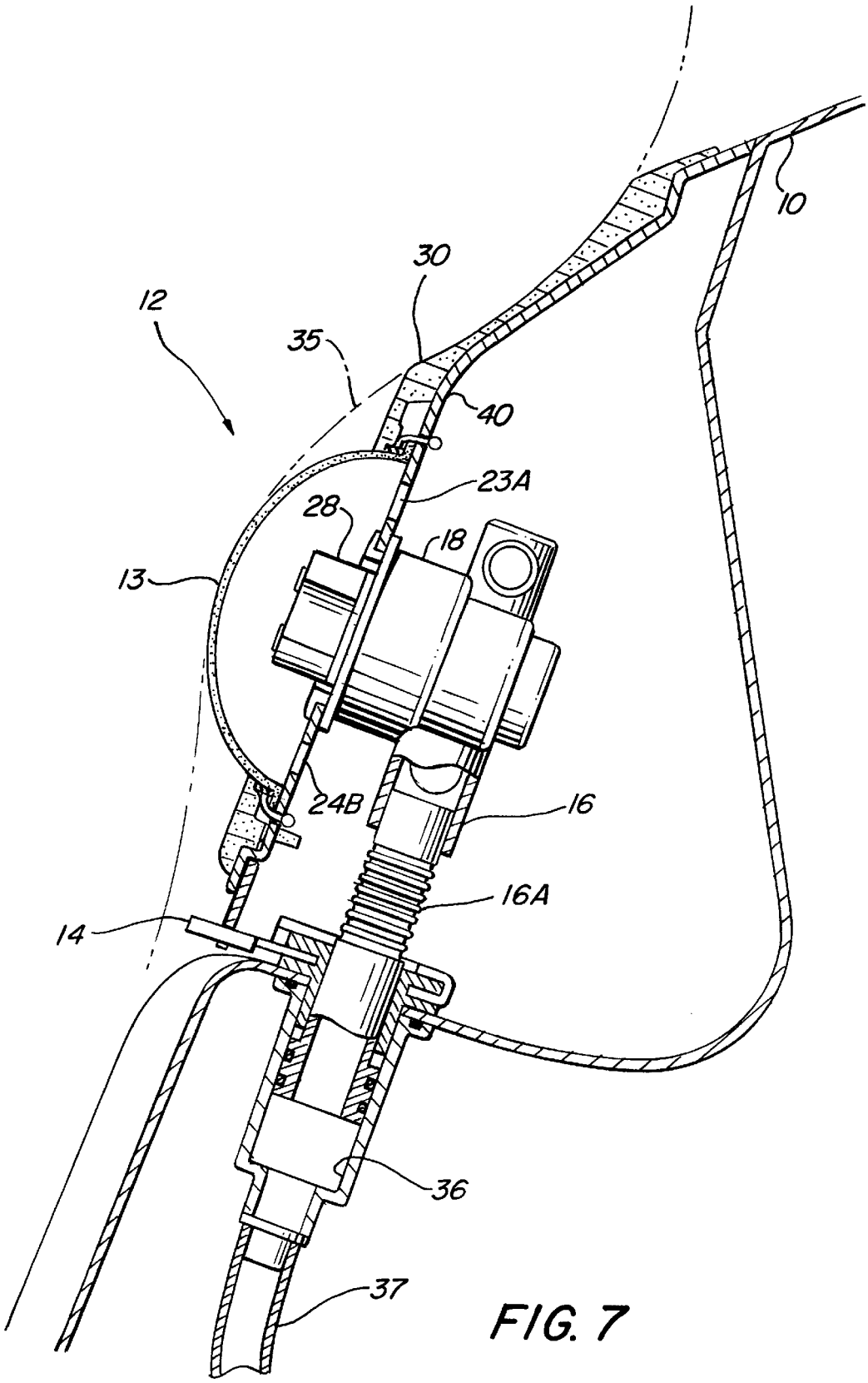
FIG. 7 is a cross-sectional view of the neck jet massage generator.

Referring now to FIG. 7, a cross-sectional view of the neck jet massage generator or pillow 12 is shown. The spa shell 10 surrounds and supports the pillow structure 12. Shadow line 35 represents that part of a user's head and neck when seated in the spa and the pillow 12 is adjusted to the correct height. The membrane 13 covers the jets, wherein only jet 28 is shown in this cross-sectional view. The air intake 16 is shown in this view, however, the water intake 15 is identical in structure. Note that a cavity 36 is formed in the intake 15, 16, which is a larger diameter than a pipe 37 supplying the air/water and the diameter of the intakes 15, 16. The cavity 36 acts as a trim valve, which provides a pressure drop at the transition point between the pipe 37 and the intakes 15, 16. This allows for minimum leakage at the base of the intake lines 15, 16 thereby providing smooth operation (without water hammer) at the base of the intake lines 15, 16 when the pump is turned on.

Figure 8:
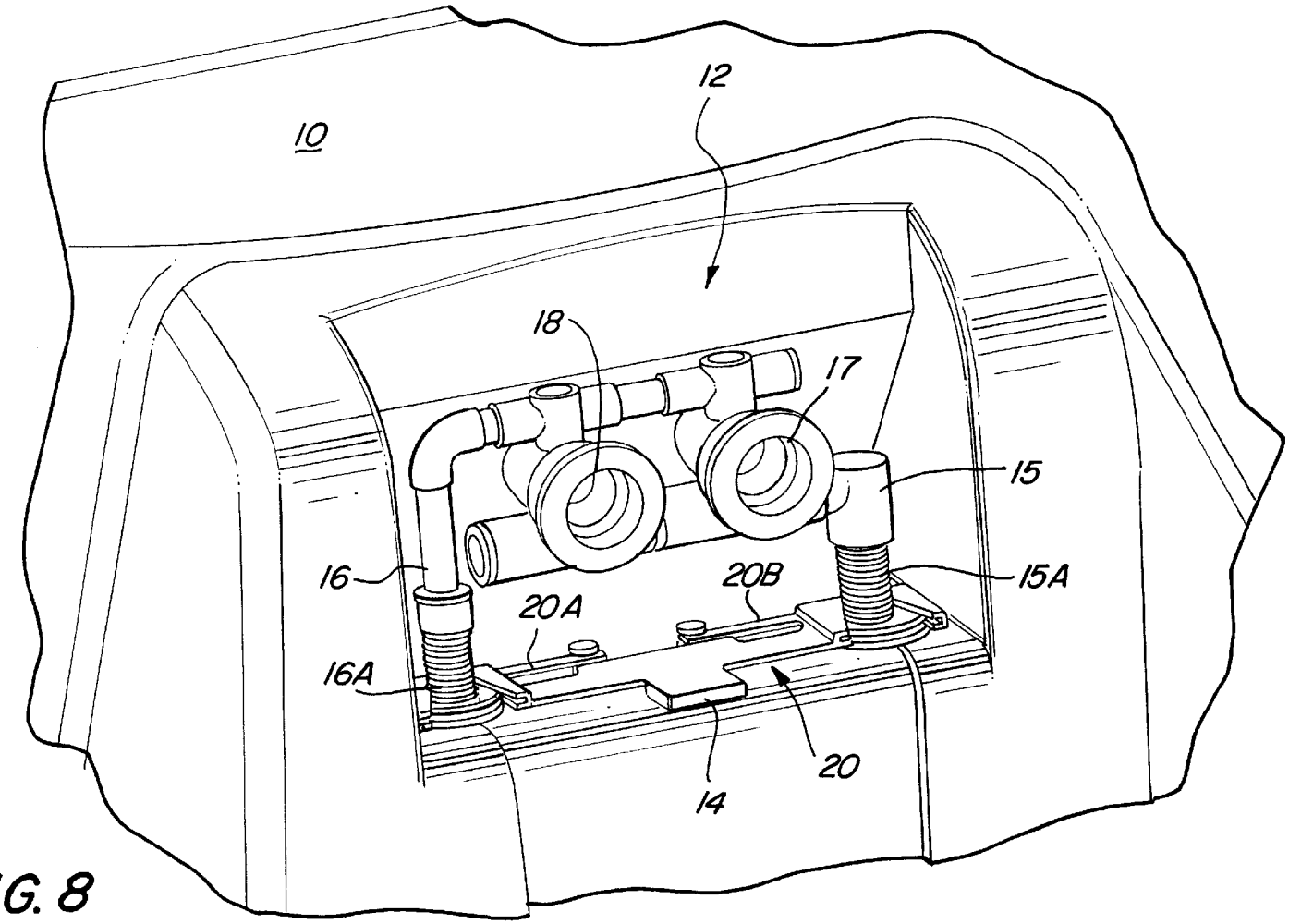
FIG. 8 is a perspective view of the neck jet massage generator plumbing as mounted in the spa including the height adjustment mechanism.

Referring now to FIG. 8, a perspective view of the neck jet massage generator 12 plumbing as mounted in the spa 10 including the height adjustment mechanism 20 is shown. Note that the height adjustment button 14 is part of the height adjustment mechanism 20.

Figure 10:
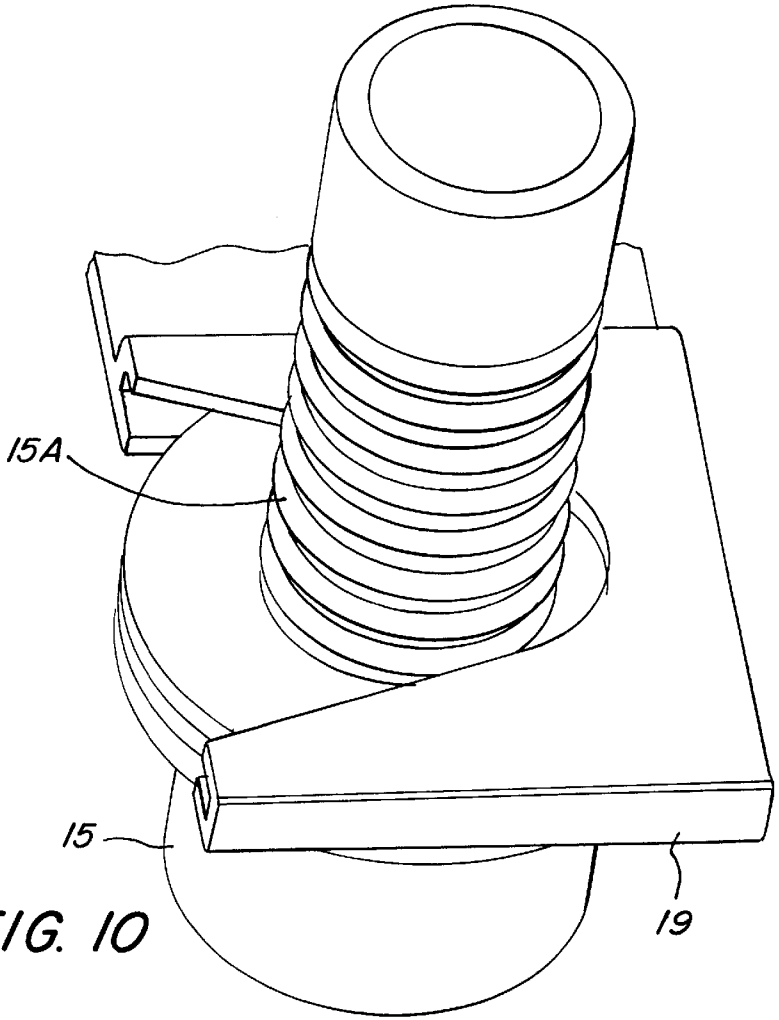
FIG. 10 is a detailed perspective view of a part of the multi-position bracket in the open position for the height adjustment mechanism.
Figure 9:
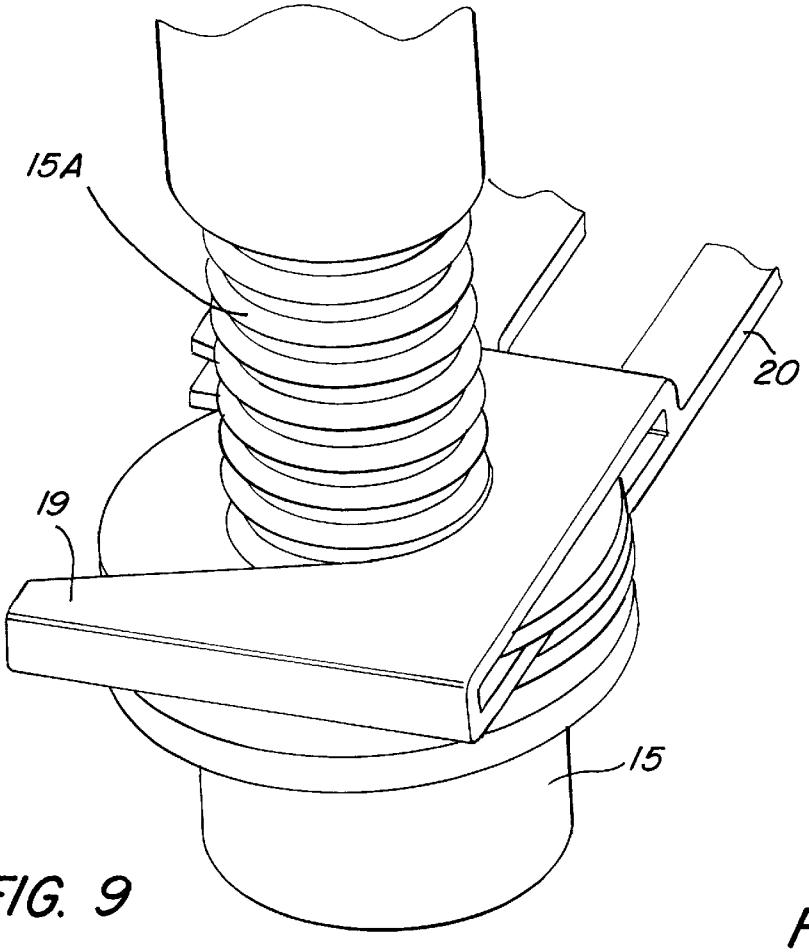
FIG. 9 is a detailed perspective view of a part of the multi-position bracket in the closed position for the height adjustment mechanism.

Referring now to FIG. 9, a detailed perspective view of a part of the height adjustment mechanism multi-position bracket in the closed position is shown; and, FIG. 10 shows the same view of a part of the height adjustment mechanism multi-position bracket, but in the open position. Note that when the mechanism 20 is in the open position (FIG. 10), the ribs 15A are cleared by part 19 so that the intake 15, as well as the pillow 12, may be moved up or down. Note also, that when the mechanism 20 is in the closed position (FIG. 9), the part 19 of the mechanism 20 engages the ribs 15A thereby locking the pillow 12 in place.

Figure 11:
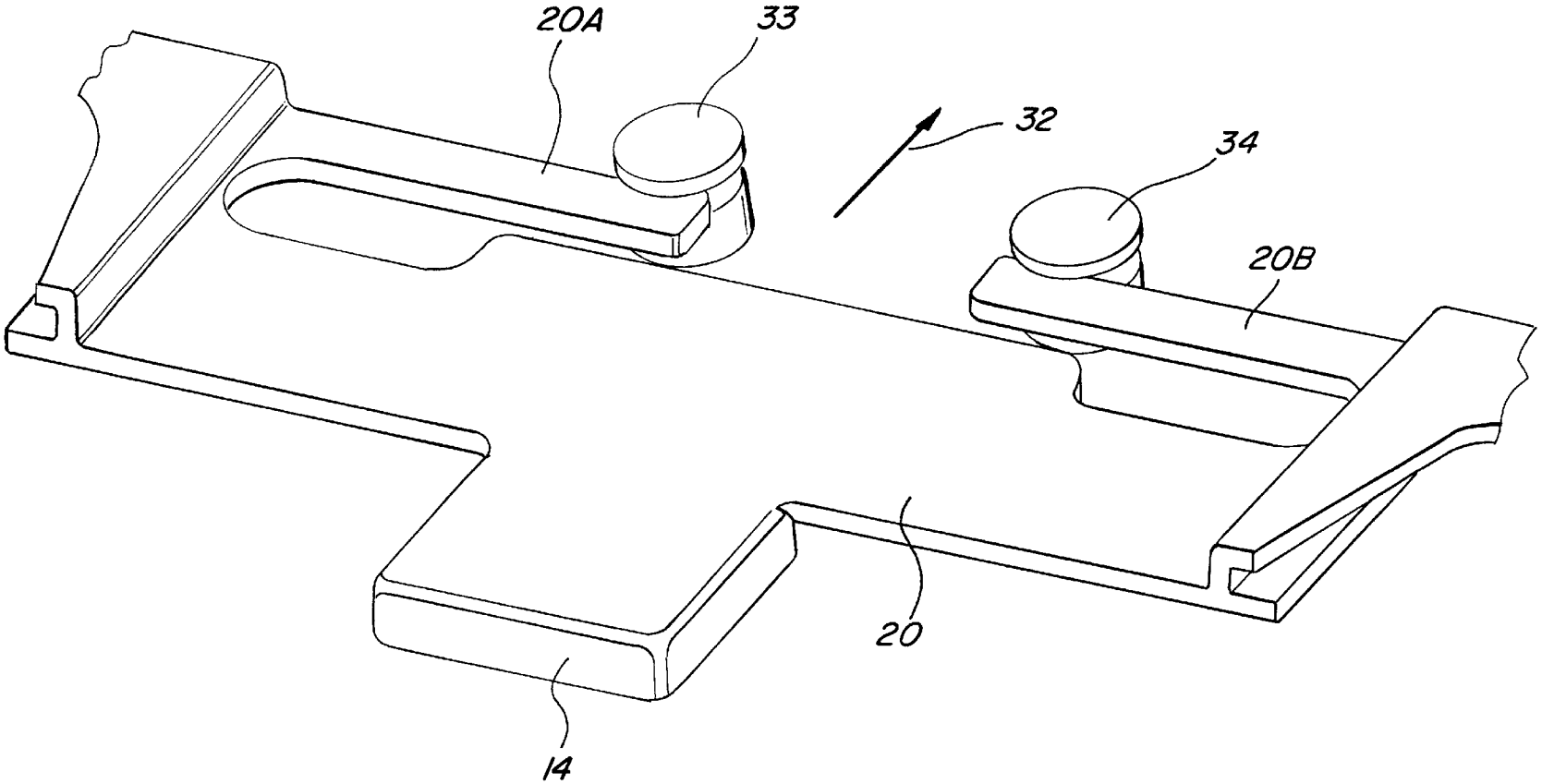
FIG. 11 is a perspective view of the spring mechanism for the neck jet massage generator height adjustment mechanism.

Referring now to FIG. 11, a perspective view of the spring mechanism for the neck jet massage generator height adjustment mechanism is shown. The mechanism includes a pair of spring members 20A and 20B (actually formed as extensions of the same piece of ABS plastic with 20% Fiber Glass. The spring members 20A and 20B abut stops 33 and 34, respectively. Pressure applied to the button 14 in the direction of arrow 32 will cause the mechanism 20 to move in the same direction, and the spring members 20A and 20B will resist such movement. When pressure is removed from the button 14, the mechanism 20 will return back to its original position. As may be appreciated with reference to FIG. 10, movement of the mechanism 20 in the direction of the arrow 32 will release the pillow 12 for movement.

While the invention has been particularly shown and described with reference to a preferred embodiment, it will be understood by those skilled in the art that various changes in form and detail may be made therein without departing from the spirit and scope of the invention.

Those skilled in the art will appreciate that various adaptations and modifications of the just-described preferred embodiments can be configured without departing from the scope and spirit of the invention. Therefore, it is to be understood that within the scope of the appended claims, the invention may be practiced other than as specifically described herein.

What is claimed is:

1. In a spa, a neck massage apparatus, comprising:

at least one jet nozzle located at a height near the neck of a user sitting in the spa, the jet nozzle being coupled to a source of water and air;

a pliable membrane disposed over the jet nozzle for restraining the water and air exiting the jet nozzle and imparting a massage sensation to the user; and a trim valve connected between the source of water and the jet nozzle.

2. The neck massage apparatus of claim 1 wherein there is a pressure differential between the water and air intake pressure and the plurality of exhaust orifices causing a pressure build up behind the membrane.

3. The neck massage apparatus of claim 2 wherein the pressure at the water and air intake is greater than the pressure at the plurality of exhaust orifices.

4. The neck massage apparatus of claim 1 further comprising a height adjustment mechanism.

5. The neck massage apparatus of claim 4 wherein the height adjustment mechanism includes a series of ridges on the water and air intakes, a slide mechanism engaging at least one of the ridges for securing the neck massage apparatus in place, when the slide mechanism is disengaged from the ridges, the neck massage apparatus is movable for adjusting the height thereof.

6. The neck massage apparatus of claim 1 wherein the combined area of the openings of the calculated orifices is larger than the combined openings of both the air and water supply lines.

7. The neck massage apparatus of claim 6 wherein the pressure at the air and water supply lines is greater than the pressure at the calculated orifices.

8. The neck massage apparatus of claim 7 wherein the pressure at the calculated orifices is between 1 and 2 PSI.

9. In a spa, a neck massage apparatus comprising:

at least one jet nozzle located at a height near the neck of a user sitting in the spa, the jet nozzle being coupled to a source of intake water and air;

a pliable membrane disposed over the jet nozzle for forming a cavity for restraining and retaining the water and air exiting the jet nozzle and imparting a massage sensation to the user;

a plurality of exhaust orifices in the cavity for exhausting water from the cavity into the spa, the plurality of exhaust orifices having a combined opening area that is larger than the combined areas of the water and air intake; and a trim valve connected between the source of intake water and the jet nozzle.

10. The neck massage apparatus of claim 9 further comprising a height adjustment mechanism.

11. The neck massage apparatus of claim 9 wherein a pressure differential between the water intake pressure and the plurality of exhaust orifices causes a pressure build up behind the membrane.

12. The neck massage apparatus of claim 11 wherein the pressure at the water intake is greater than the pressure at the plurality of exhaust orifices.

13. In a spa, a neck massage apparatus comprising:

at least one jet nozzle located at a height near the neck of a user sitting in the spa, the jet nozzle being coupled to a source of water and air intake;

a pliable membrane disposed over the jet nozzle for restraining the water and air exiting the jet nozzle and imparting a massage sensation to the user; and a height adjustment mechanism having a series of ridges on the water or air intake, a slide mechanism engaging at least one of the ridges for securing the neck massage apparatus in place, when the slide mechanism is disengaged from the ridges, the neck massage apparatus is moveable for adjusting the height.

14. A neck massage apparatus for use in a spa comprising:

a jet nozzle disposed at a height near the neck of a user sitting in the spa, the jet nozzle being coupled to a source of water and air;

a pliable membrane disposed over the jet nozzle for forming a neck-supporting pillow and a chamber for collecting the water and air exiting the nozzle and for imparting a massage sensation to the user;

a plurality of calculated orifices in the chamber for controlling water drainage from the chamber back to the spa, the pressure in the source of water for the jet nozzle being higher than the pressure at the calculated orifices; and a height adjustment mechanism having a series of ridges on the water and air intakes, a slide mechanism engaging at least one of the ridges for securing the neck massage apparatus in place, the neck massage apparatus being movable for adjusting the height when the slide mechanism is disengaged.

15. The neck massage apparatus of claim 14 wherein the combined area of the openings of the calculated orifices is larger than the combined area of the openings of both the air and water supply lines.

16. The neck massage apparatus of claim 15 wherein the pressure at the air and water supply lines is greater than the pressure at the calculated orifices.

17. The neck massage apparatus of claim 16 wherein the pressure at the calculated orifices is between 1 and 2 PSI.

* * * * *